US009334713B2

(12) United States Patent
van Petegem

(10) Patent No.: US 9,334,713 B2
(45) Date of Patent: May 10, 2016

(54) PRODUCED SAND GRAVEL PACK PROCESS

(71) Applicant: Ronald van Petegem, Montgomery, TX (US)

(72) Inventor: Ronald van Petegem, Montgomery, TX (US)

( * ) Notice: Subject to any disclaimer, the term of this patent is extended or adjusted under 35 U.S.C. 154(b) by 67 days.

(21) Appl. No.: 13/653,690

(22) Filed: Oct. 17, 2012

(65) Prior Publication Data

US 2014/0102702 A1 Apr. 17, 2014
US 2014/0202694 A9 Jul. 24, 2014

Related U.S. Application Data

(60) Continuation-in-part of application No. 12/690,292, filed on Jan. 20, 2010, which is a continuation-in-part of application No. 12/151,429, filed on May 6, 2008, now Pat. No. 7,956,017, which is a division of application No. 11/298,547, filed on Dec. 9, 2005, now Pat. No. 7,392,847, said application No. 12/690,292 is a continuation-in-part of application No. 12/075,461, filed on Mar. 11, 2008, now Pat. No. 7,829,510, which is a division of application No. 11/298,556, filed on Dec. 9, 2005, now Pat. No. 7,350,579.

(60) Provisional application No. 61/146,386, filed on Jan. 22, 2009.

(51) Int. Cl.
*E21B 43/04* (2006.01)
*E21B 43/08* (2006.01)
*E21B 43/25* (2006.01)

(52) U.S. Cl.
CPC ..... *E21B 43/08* (2013.01); *E21B 43/04* (2013.01); *E21B 43/25* (2013.01)

(58) Field of Classification Search
None
See application file for complete search history.

(56) References Cited

U.S. PATENT DOCUMENTS 2,196,042 A 4/1940 Timpson ..... 23/11
2,390,153 A 12/1945 Kern ..... 260/72
2,805,958 A 7/1959 Bueche et al. ..... 106/308

(Continued)

FOREIGN PATENT DOCUMENTS

CA 2125513 1/1995
DE 4027300 5/1992 ..... B10D 53/14

(Continued)

OTHER PUBLICATIONS

SPE International, Central AR, "Enchancing Gas and Oil Production with Zeta Potential Altering System—SPE128048", Feb. 24, 2011, Faulkner County Natural Resource Center, 110 S. Amity Rd., Conway, AR 72032.

(Continued)

*Primary Examiner* — Angela M DiTrani
(74) *Attorney, Agent, or Firm* — Blank Rome LLP

(57) ABSTRACT

A borehole completion method treats a formation surrounding a borehole with a chemical treatment that alters how formation particulates interact. A standalone screen deploys downhole in the borehole (either before or after the treatment) on a downhole string. When fluid is produced, formation particulates treated with the chemical treatment agglomerate in the annulus surrounding the screen in permeable structures. This can be especially when the standalone screen is useful in a cased hole having perforations. The chemical treatment includes an inner salt adapted to neutralize the zeta potential (i.e., electrokinetic potential) of the formation particulates so they aggregate into one or more permeable structures in the annulus.

38 Claims, 3 Drawing Sheets

(56) References Cited

U.S. PATENT DOCUMENTS 3,059,909 A 10/1962 Wise ..... 261/39.3
3,088,520 A 5/1963 Hildebrandt
3,163,219 A 12/1964 Wyant et al. ..... 166/283
3,301,723 A 1/1967 Chrisp ..... 149/20
3,301,848 A 1/1967 Halleck ..... 536/123.1
3,303,896 A 2/1967 Tillotson et al. ..... 175/69
3,317,430 A 5/1967 Priestley et al. ..... 510/503
3,565,176 A 2/1971 Wittenwyler ..... 166/270
3,637,014 A * 1/1972 Jones ..... 166/268
3,729,052 A 4/1973 Caldwell
3,856,921 A 12/1974 Shrier et al. ..... 423/228
3,888,312 A 6/1975 Tiner et al. ..... 166/308.5
3,933,205 A 1/1976 Kiel ..... 166/308.1
3,937,283 A 2/1976 Blauer et al. ..... 166/307
3,960,736 A 6/1976 Free et al. ..... 507/216
3,965,982 A 6/1976 Medlin ..... 166/249
3,990,978 A 11/1976 Hill ..... 507/235
4,007,792 A 2/1977 Meister ..... 156/308.2
4,052,159 A 10/1977 Fuerst et al.
4,067,389 A 1/1978 Savins ..... 166/246
4,108,782 A 8/1978 Thompson ..... 507/205
4,112,050 A 9/1978 Sartori et al. ..... 423/223
4,112,051 A 9/1978 Sartori et al. ..... 423/223
4,112,052 A 9/1978 Sartori et al. ..... 423/223
4,113,631 A 9/1978 Thompson ..... 507/202
4,378,845 A 4/1983 Medlin et al. ..... 166/297
4,461,716 A 7/1984 Barbarin et al. ..... 252/307
4,479,041 A 10/1984 Fenwick et al. ..... 200/81 R
4,506,734 A 3/1985 Nolte ..... 166/308.1
4,514,309 A 4/1985 Wadhwa ..... 507/211
4,541,935 A 9/1985 Constien et al. ..... 507/225
4,549,608 A 10/1985 Stowe et al. ..... 166/280.1
4,561,985 A 12/1985 Glass, Jr. ..... 507/108
4,623,021 A 11/1986 Stowe ..... 166/250.1
4,654,266 A 3/1987 Kachnik ..... 428/403
4,657,081 A 4/1987 Hodge ..... 166/380.5
4,660,643 A 4/1987 Perkins ..... 166/283
4,683,068 A 7/1987 Kucera ..... 507/201
4,686,052 A 8/1987 Baranet et al. ..... 507/244
4,695,389 A 9/1987 Kubala ..... 507/244
4,705,113 A 11/1987 Perkins ..... 166/302
4,714,115 A 12/1987 Uhri ..... 166/308.1
4,718,490 A 1/1988 Uhri ..... 166/281
4,724,905 A 2/1988 Uhri ..... 166/250.1
4,725,372 A 2/1988 Teot et al. ..... 507/129
4,739,834 A 4/1988 Peiffer et al. ..... 166/308.4
4,741,401 A 5/1988 Walles et al. ..... 166/300
4,748,011 A 5/1988 Baize ..... 423/228
4,779,680 A 10/1988 Sydansk ..... 166/300
4,795,574 A 1/1989 Syrinek et al. ..... 507/238
4,817,717 A 4/1989 Jennings, Jr. et al. ..... 166/278
4,830,106 A 5/1989 Uhri ..... 166/250.1
4,846,277 A 7/1989 Khalil et al. ..... 166/280.1
4,848,468 A 7/1989 Hazlett et al. ..... 166/300
4,852,650 A 8/1989 Jennings, Jr. et al. ..... 166/250.1
4,869,322 A 9/1989 Vogt, Jr. et al. ..... 166/280.1
4,892,147 A 1/1990 Jennings, Jr. et al. ..... 166/280.2
4,926,940 A 5/1990 Stromswold ..... 166/247
4,938,286 A 7/1990 Jennings, Jr. ..... 166/280.1
4,978,512 A 12/1990 Dillon ..... 423/226
5,005,645 A 4/1991 Jennings, Jr. et al. ..... 166/280.1
5,024,276 A 6/1991 Borchardt ..... 166/308.6
5,067,556 A 11/1991 Fudono et al. ..... 62/196.4
5,074,359 A 12/1991 Schmidt ..... 166/280.1
5,074,991 A 12/1991 Weers ..... 208/236
5,082,579 A 1/1992 Dawson ..... 507/211
5,106,518 A 4/1992 Cooney et al. ..... 507/21
5,110,486 A 5/1992 Manalastas et al. ..... 507/260
5,169,411 A 12/1992 Weers ..... 44/421
5,224,546 A 7/1993 Smith et al. ..... 166/300
5,228,510 A 7/1993 Jennings, Jr. et al. ..... 166/263
5,246,073 A 9/1993 Sandiford et al. ..... 166/295
5,259,455 A 11/1993 Nimerick et al. ..... 166/308.5
5,330,005 A 7/1994 Card et al. ..... 166/280.2
5,342,530 A 8/1994 Aften et al. ..... 252/8.551
5,347,004 A 9/1994 Rivers et al. ..... 544/180
5,363,919 A 11/1994 Jennings, Jr. ..... 166/308.1
5,402,846 A 4/1995 Jennings, Jr. et al. ..... 166/259
5,411,091 A 5/1995 Jennings, Jr. ..... 166/280.1
5,424,284 A 6/1995 Patel et al. ..... 507/129
5,439,055 A 8/1995 Card et al. ..... 166/280.2
5,462,721 A 10/1995 Pounds et al. ..... 423/226
5,465,792 A 11/1995 Dawson et al. ..... 166/295
5,472,049 A 12/1995 Chaffee et al. ..... 166/250.1
5,482,116 A 1/1996 El-Rabaa et al. ..... 166/250.1
5,488,083 A 1/1996 Kinsey, III et al. ..... 507/211
5,497,831 A 3/1996 Hainey et al. ..... 166/308.1
5,501,275 A 3/1996 Card et al. ..... 166/280.2
5,551,516 A 9/1996 Norman et al. ..... 166/308.2
5,614,010 A 3/1997 Smith et al.
5,624,886 A 4/1997 Dawson et al. ..... 507/217
5,635,458 A 6/1997 Lee et al. ..... 507/240
5,649,596 A 7/1997 Jones et al. ..... 166/300
5,669,447 A 9/1997 Walker et al. ..... 166/300
5,674,377 A 10/1997 Sullivan, III et al. ..... 208/208 R
5,688,478 A 11/1997 Pounds et al. ..... 423/228
5,693,837 A 12/1997 Smith et al. ..... 556/148
5,711,396 A 1/1998 Joerg et al. ..... 180/444
5,722,490 A 3/1998 Ebinger ..... 166/281
5,744,024 A 4/1998 Sullivan, III et al. ..... 208/236
5,755,286 A 5/1998 Ebinger ..... 166/281
5,775,425 A 7/1998 Weaver et al. ..... 166/276
5,787,986 A 8/1998 Weaver et al. ..... 166/280.2
5,806,597 A 9/1998 Tjon-Joe-Pin et al. ..... 166/300
5,807,812 A 9/1998 Smith et al. ..... 507/238
5,833,000 A 11/1998 Weaver et al. ..... 166/276
5,853,048 A 12/1998 Weaver et al. ..... 166/279
5,871,049 A 2/1999 Weaver et al. ..... 166/276
5,877,127 A 3/1999 Card et al. ..... 507/273
5,908,073 A 6/1999 Nguyen et al. ..... 166/276
5,908,814 A 6/1999 Patel et al. ..... 507/131
5,964,295 A 10/1999 Brown et al. ..... 166/308.2
5,979,557 A 11/1999 Card et al. ..... 166/300
5,980,845 A 11/1999 Cherry ..... 423/229
6,016,871 A 1/2000 Burts, Jr. ..... 166/300
6,035,936 A 3/2000 Whalen ..... 166/308.5
6,047,772 A 4/2000 Weaver et al. ..... 166/276
6,054,417 A 4/2000 Graham et al. ..... 507/238
6,059,034 A 5/2000 Rickards et al. ..... 166/280.2
6,060,436 A 5/2000 Snyder et al. ..... 507/266
6,069,118 A 5/2000 Hinkel et al. ..... 507/277
6,123,394 A 9/2000 Jeffrey ..... 299/16
6,133,205 A 10/2000 Jones ..... 507/276
6,147,034 A 11/2000 Jones et al. ..... 507/238
6,162,449 A 12/2000 Maier et al. ..... 424/401
6,162,766 A 12/2000 Muir et al. ..... 507/267
6,169,058 B1 1/2001 Le et al. ..... 507/222
6,228,812 B1 5/2001 Dawson et al. ..... 507/221
6,247,543 B1 6/2001 Patel et al. ..... 175/64
6,267,938 B1 7/2001 Warrender et al. ..... 423/226
6,283,212 B1 9/2001 Hinkel et al. ..... 166/279
6,291,405 B1 9/2001 Lee et al. ..... 507/136
6,330,916 B1 12/2001 Rickards et al. ..... 166/280.2
6,725,931 B2 4/2004 Nguyen et al. ..... 166/280.2
6,756,345 B2 6/2004 Pakulski et al. ..... 507/246
6,793,018 B2 9/2004 Dawson et al. ..... 166/300
6,832,650 B2 12/2004 Nguyen et al. ..... 166/279
6,875,728 B2 4/2005 Gupta et al. ..... 507/240
7,140,433 B2 11/2006 Gatlin et al. ..... 166/250.01
7,268,100 B2 9/2007 Kippie et al. ..... 507/244
7,350,579 B2 4/2008 Gatlin et al. ..... 166/308.3
7,392,847 B2 7/2008 Gatlin et al. ..... 166/280.2
7,517,447 B2 4/2009 Gatlin ..... 208/236
7,565,933 B2 7/2009 Kippie et al.
7,566,686 B2 7/2009 Kippie et al. ..... 507/213
7,712,535 B2 5/2010 Venditto et al.
7,767,628 B2 8/2010 Kippie et al. ..... 507/102
7,829,510 B2 11/2010 Gatlin et al.
7,956,017 B2 6/2011 Gatlin et al.
2002/0049256 A1 4/2002 Bergeron, Jr. ..... 514/674
2002/0165308 A1 11/2002 Kinniard et al. ..... 524/492
2003/0220204 A1 11/2003 Baran, Jr. et al. ..... 507/200
2005/0045330 A1 3/2005 Nguyen et al. ..... 166/281
2005/0092489 A1 5/2005 Welton et al. ..... 166/280.2

(56) References Cited

U.S. PATENT DOCUMENTS

| | | | | |
|---|---|---|---|---|
| 2005/0137114 | A1 | 6/2005 | Gatlin et al. | 510/424 |
| 2005/0250666 | A1 | 11/2005 | Gatlin et al. | 510/492 |
| 2006/0194700 | A1 | 8/2006 | Gatlin et al. | 507/203 |
| 2006/0219405 | A1* | 10/2006 | Nguyen et al. | 166/281 |
| 2007/0032693 | A1 | 2/2007 | Gatlin et al. | 507/239 |
| 2007/0131425 | A1 | 6/2007 | Gatlin et al. | |
| 2007/0173413 | A1 | 7/2007 | Lukocs et al. | 507/238 |
| 2007/0173414 | A1 | 7/2007 | Wilson, Jr. | 507/131 |
| 2008/0011478 | A1* | 1/2008 | Welton et al. | 166/280.2 |
| 2008/0197085 | A1 | 8/2008 | Wanner et al. | |
| 2008/0251252 | A1 | 10/2008 | Schwartz | |
| 2008/0257553 | A1 | 10/2008 | Gatlin et al. | 166/280.2 |
| 2008/0257554 | A1 | 10/2008 | Zamora et al. | |
| 2008/0269082 | A1 | 10/2008 | Wilson, Jr. et al. | |
| 2008/0283242 | A1 | 11/2008 | Ekstrand et al. | |
| 2008/0287325 | A1 | 11/2008 | Thompson et al. | |
| 2008/0314124 | A1 | 12/2008 | Sweeney et al. | |
| 2008/0318812 | A1 | 12/2008 | Kakadjian et al. | |
| 2009/0067931 | A1 | 3/2009 | Curr et al. | |
| 2009/0151959 | A1 | 6/2009 | Darnell et al. | |
| 2009/0173497 | A1* | 7/2009 | Dusterhoft | 166/276 |
| 2009/0200027 | A1 | 8/2009 | Kakadjian et al. | |
| 2009/0200033 | A1 | 8/2009 | Kakadjian et al. | |
| 2009/0203553 | A1 | 8/2009 | Gatlin et al. | |
| 2009/0250659 | A1 | 10/2009 | Gatlin | 208/236 |
| 2010/0000795 | A1 | 1/2010 | Kakadjian et al. | |
| 2010/0012901 | A1 | 1/2010 | Falana et al. | |
| 2010/0077938 | A1 | 4/2010 | Zamora et al. | |
| 2010/0122815 | A1 | 5/2010 | Zamora et al. | |
| 2010/0181071 | A1 | 7/2010 | van Petegen | |
| 2010/0197968 | A1 | 8/2010 | Falana et al. | |
| 2010/0212905 | A1* | 8/2010 | van Petegem et al. | 166/308.2 |
| 2010/0252262 | A1 | 10/2010 | Ekstrand et al. | |
| 2012/0043082 | A1* | 2/2012 | Nguyen et al. | 166/295 |
| 2013/0075100 | A1* | 3/2013 | Veldman et al. | 166/310 |

FOREIGN PATENT DOCUMENTS

| | | | | |
|---|---|---|---|---|
| GB | 775376 | | 10/1954 | |
| GB | 1073338 | A | 6/1967 | |
| JP | 10001461 | | 6/1988 | C07C 211/50 |
| JP | 08151422 | | 11/1996 | |
| JP | 10110115 | A | 4/1998 | |
| JP | 2005194148 | A | 7/2005 | |
| WO | WO 98/56497 | | 12/1998 | |
| WO | 99/05385 | A2 | 2/1999 | |

OTHER PUBLICATIONS

SPE International, Central Arkansas Study Group, Neswletter—"Presentation on Zeta Potential Altering System for Hudraulic Fracturing on Feb. 24", pp. 1-4, vol. 3, Issue 4, Copyright 2011 All Rights Reserved.

Johnson, D et al., "Enchancing Gas and Oil Production with Zeta Potential Altering System", SPE 128048, Copyright 2010, Society of Petroleum Engineers.

Kakadijan, Sarkis et al., "Zeta Potential Altering System for Increased Fluid Recovery, Production, and Fines Control", SPE 106112, Copyright 2007, Society of Petroleum Engineers.

U.S. Appl. No. 12/750,335, filed Mar. 30, 2010, Parker.

U.S. Appl. No. 12/473,805, filed May 28, 2009, Falana et al.

* cited by examiner

PRODUCED SAND GRAVEL PACK PROCESS

BACKGROUND

Several types of screens are used downhole to filter produced fluids of formation particulates, such as sand. The screens can include wire-wrapped screens, metal-mesh screens, and expandable screens, among others. The screens can be used downhole in a number of completion systems to control sand. In a gravel pack operation, for example, gravel is placed in the annulus around the screen in an open hole. Alternatively, the screen can be run in a stand-alone application without a surrounding gravel pack in either a cased or an open hole.

A stand-alone screen can become plugged and/or may erode rapidly as formation sand and other produced particulates pass through the screen during production. When plugging or erosion occurs, operators need to take remedial steps to clean out and/or replace the screen, which can be time-consuming and costly. Plugging and erosion can be especially problematic when the stand-alone screen is run in a cased hole. For this reason, a stand-alone screen is only rarely run in a cased hole. Yet, being able to run a stand-alone screen in a cased hole may be beneficial in some circumstances and may also be beneficial when using screens in open hole applications.

The subject matter of the present disclosure is directed to overcoming, or at least reducing the effects of, one or more of the problems set forth above.

SUMMARY

A borehole completion method treats a formation surrounding a borehole with a chemical treatment. A standalone screen deploys downhole in the borehole (either before, during, or after the treatment) on a downhole string. Any suitable type of standalone screen can be used, including a wire screen, a mesh screen, a sintered metal screen, a perforated pipe, an expandable screen, a gravel pack screen, or a combination thereof. Typically, packers disposed on the string are used to isolate the screen to particular portions of the borehole.

When fluid is produced from the formation through the screen, formation particulates treated with the chemical treatment are produced with the fluid from the formation, and they agglomerate in the annulus surrounding the screen in permeable structures to form a type of "gravel pack" structure. With the permeable structures formed in the annulus, operators do not need to actively pack the annulus with gravel.

The chemical treatment to agglomerate formation particulates can be especially useful in a cased hole having perforations, but the process may also be beneficial for open hole applications. A standalone screen in a cased hole can be prone to clogging and erosion. Thus, the chemical treatment can be passed through perforations in the casing to treat the surrounding formation. This can be accomplished by injecting the chemical treatment directly in the borehole through the screen, by capillary string, or other conveyance.

The chemical treatment includes an inner salt adapted to modify the zeta potential of the formation particulates. As discussed herein, zeta potential of a particulate refers to the electrokinetic potential of the particulates and is represented by a charge of the particulates' surfaces. To agglomerate the particulates, the chemical treatment neutralizes the zeta potential of the formation particulates so they aggregate into one or more permeable structures in the annulus.

The foregoing summary is not intended to summarize each potential embodiment or every aspect of the present disclosure.

DETAILED DESCRIPTION

Figure 1:
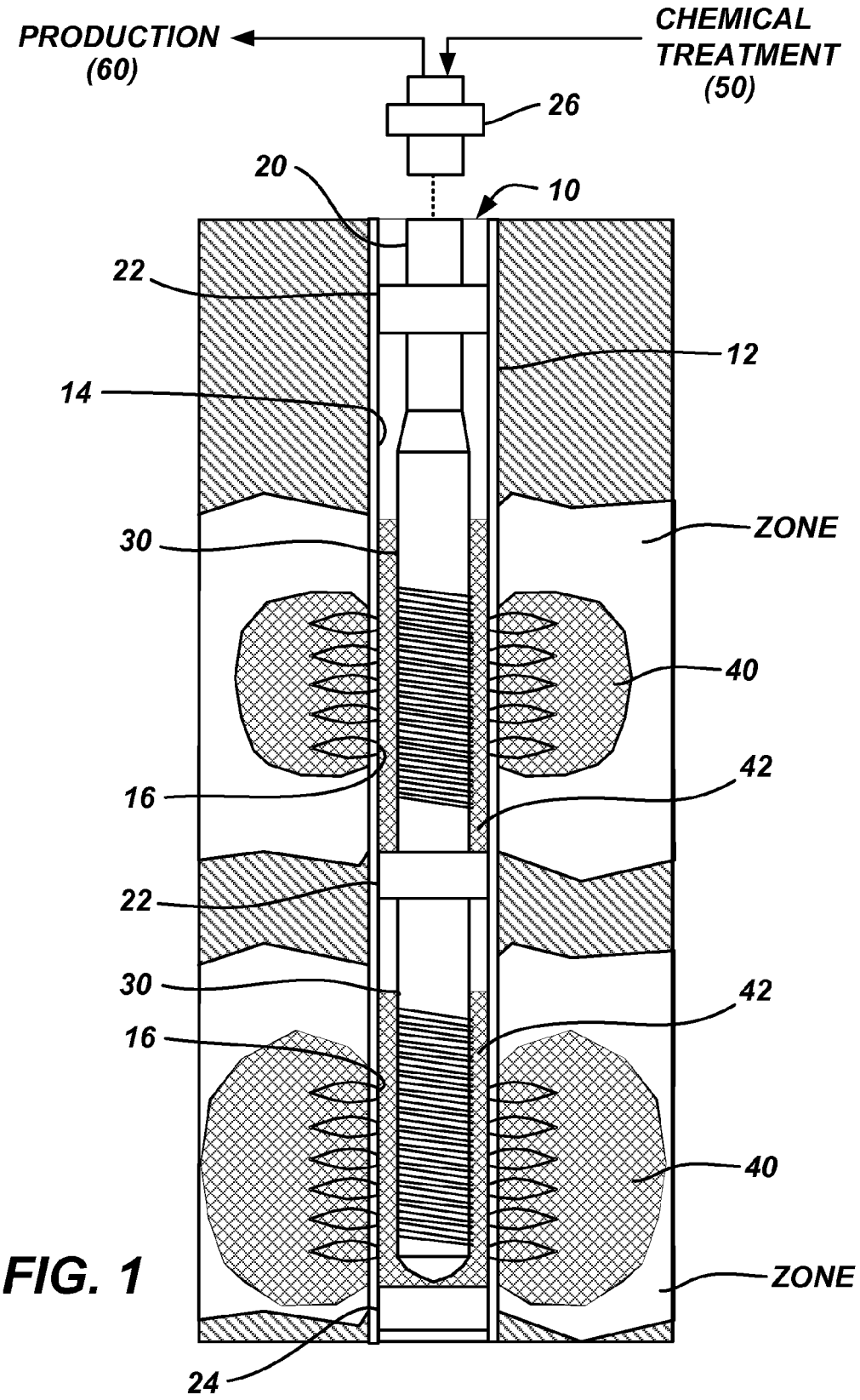
FIG. 1 illustrates a borehole of a formation having a completion string with multiple stand-alone screens.

In FIG. 1, a completion string 20 has a number of stand-alone screens 30 deployed in a cased hole 10. Packers 22 disposed at various intervals between zones of interest isolate the annulus 14 between the casing 12 and the string 20, and the cased hole 10 has perforations 16 communicating with the surrounding formation of these zones. As fluid is produced from the formation, the produced fluid can pass through the perforations 16 into the borehole annulus 14. In turn, the produced fluid can enter the screens 30 and be produced up the string 20 at various wellhead components 26. As shown, a mechanical barrier 24 can be disposed downhole of the string 20 to isolate the bottom of the cased hole 10.

The screens 30 used can include any of the conventional screens used for gravel pack operations, frac pack operations, or wellscreen operations. Therefore, the screens 30 can use wrapped wire, sintered metal, mesh, perforated pipe, ceramic screens, and other components.

During production (60), fluid is produced from the formation through the casing's perforations 16. As this process proceeds, formation sand and other particulates may tend to plug and/or erode the screens 30, and this may be accelerated by virtue of the perforations 16 in the cased hole 10. To reduce the chances of plugging and erosion, the completion has a chemical treatment (50) applied to surrounding portions or areas 40 of the formation according to the procedures disclosed herein. (FIG. 2, which is discussed below, shows one technique for treating areas 40 of the formation with the chemical treatment (50).) These treated areas 40 can extend into the surrounding formation as shown. The actual extent of these treated areas 40 may vary depending on how much chemical treatment is applied, characteristics of the formation, and other factors.

Figure 3:
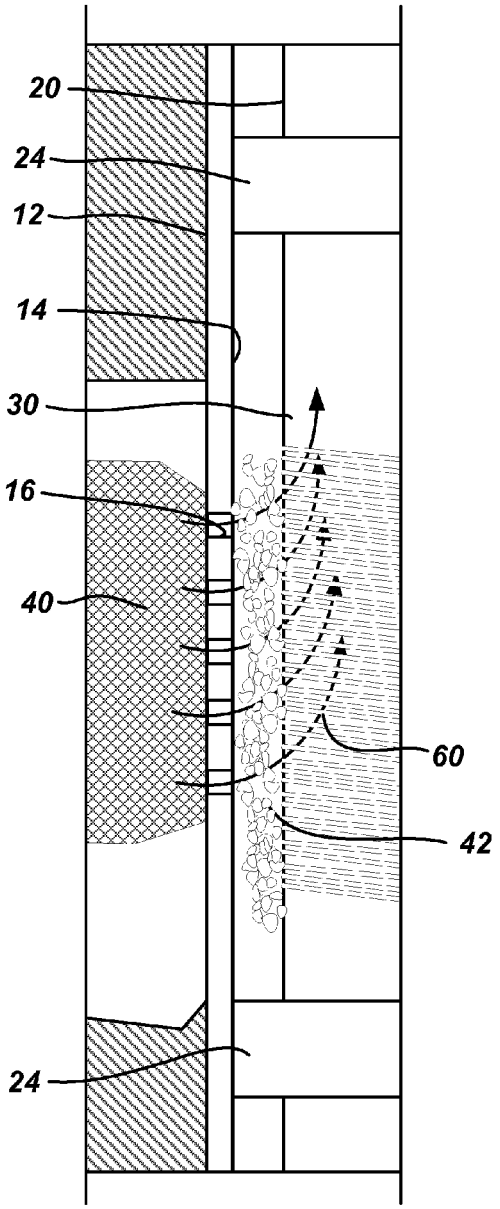
FIG. 3 illustrates agglomerating of formation particulates treated with the chemical treatment and produced with the fluid from the formation in an annulus surrounding the screen.

In any event, as shown in FIGS. 1 and 3, produced fluid 60 exits the treated formation area 40 through the perforations 16, sand and other particulates produced with the fluid will tend to collect in the annulus 14 surrounding the screen 30 and the casing 12. Left alone, these formation particulates would tend to plug and erode the screens 30. Being chemically treated, however, the collected formation particulate is intended to have a significant amount of permeability that tends to reduce plugging and erosion. Moreover, the chemically treated formation particulate agglomerates together in the annulus 14 to form one or more permeable structures 42 for filtering produced fluids and reducing plugging and erosion of the screens 30. In other words, these permeable structures 42 can act as a gravel pack formed from the produced sand and particulate in the annulus 14 around the screen 30 without the structures 42 being formally placed there through gravel packing operations.

Although the chemical treatment (50) is applied to the cased hole 10 in which the stand-alone screens 30 are used, the teachings of the present disclosure can be used in open holes in which stand-alone screens are used. Moreover, the borehole 10 may have a combination of cased and open hole sections as found in the art.

Figure 4:
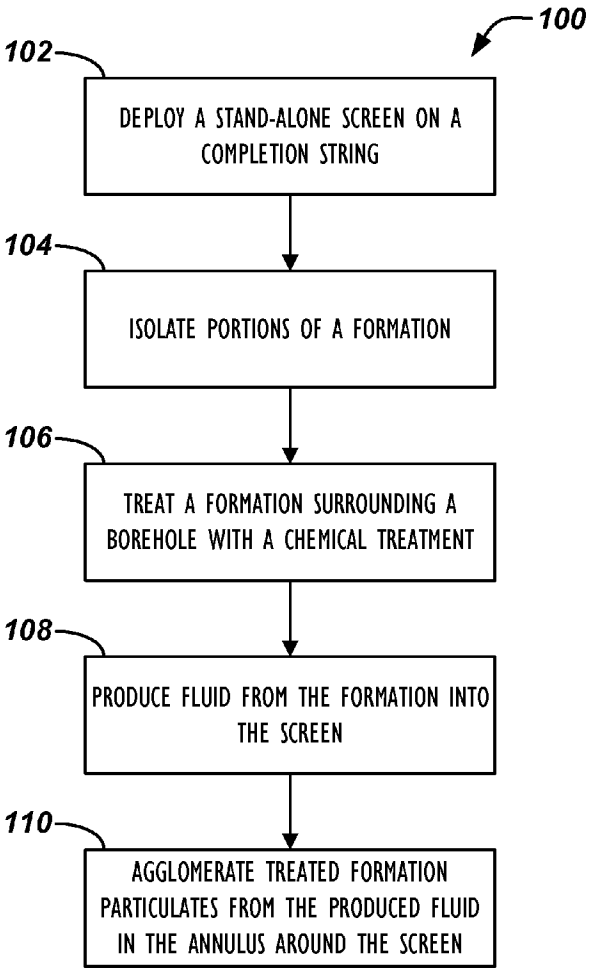
FIG. 4 illustrates a process for chemically treating a formation so plugging and erosion can be reduced for stand-alone screens deployed downhole.

Still referring to the components in FIGS. 1 and 3, discussion now turns to the flowchart in FIG. 4, which shows a process 100 for chemically treating the surrounding formation to reduce plugging and erosion for stand-alone screens 30. Initially, the completion string 20 is deployed in the borehole 10 and has a number of packers 22 and stand-alone screens 30 on the production tubing (Block 102). The packers 22 can then be activated to isolate the zones of interest in the formation from one another according to customary procedures (Block 104).

A chemical treatment (50) is then applied downhole so that it permeates into the surrounding formation (Block 106). As noted above, the borehole 10 through the formation may have a cased hole with perforations 16 or may be an open hole. In general, the treatment (50) can be applied before, during, and/or after the screens 30 and completion string 20 have been deployed. Accordingly, the procedure for treating the formation can use any of the available methods depending on what tools can be deployed, how the chemical treatment (50) can be conveyed downhole, and other factors known in the art. Thus, standard chemical injection procedures can be used to apply the chemical treatment (50). Some of these standard chemical injection procedures can involve pumping the treatment (50) directly down the completion string 20, applying the treatment (50) with a capillary or workstring deployed in the completion string 20, or other techniques.

When the chemical treatment (50) is applied after the completion string 20 is run, for example, the chemical additive of the treatment (50) can be pumped down the tubing string 20 so that it exits the screens 30 and enters the formation through the cased hole perforations 16. This chemical additive can even be part of a frac operation used to stimulate the formation.

Figure 2:
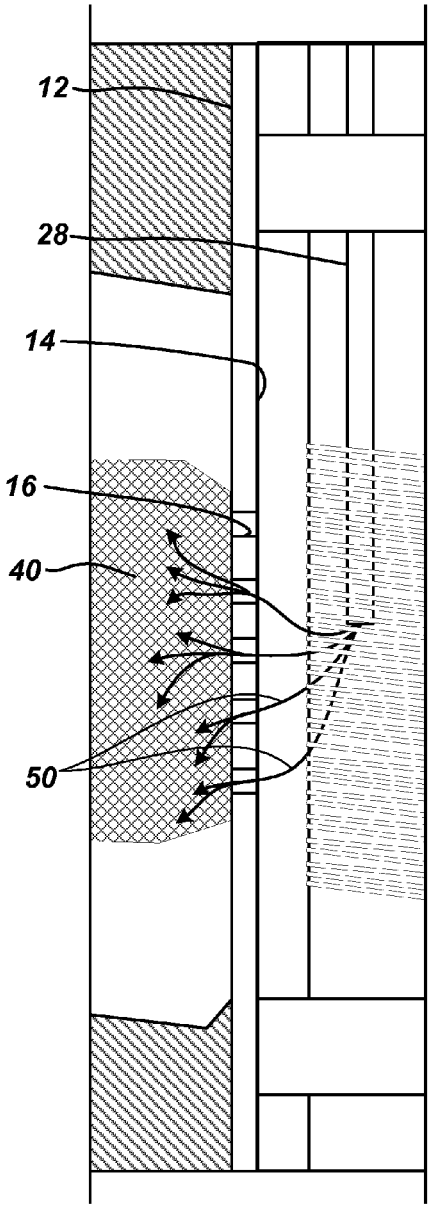
FIG. 2 illustrates one technique for injecting chemical treatment into the formation.

As one example placement technique shown in FIG. 2, chemical injection uses a "self-diverting" fluid for the chemical treatment 50. This fluid is designed to be very thin and easy to inject into the formation. A capillary or workstring string 28 deployed in the completion string 20 injects the thin fluid for the chemical treatment 50 downhole, and the injected fluid passes out of the screen 30 and through the perforations 16. Entering the formation through the perforations 16, the injected fluid migrates into the surrounding area 40 of the formation. As the thin fluid migrates, the velocity and shear rate of the fluid is reduced, causing the fluid to become more viscous. In turn, the increasing viscosity of the migrating fluid causes the following fluids being injected behind it to be diverted to other parts of the formation in a self-diverting process.

Returning back to FIG. 4, the chemical treatment (50) treats the formation substrate (sand, particulates, etc.) with the chemical additive that allows the formation particulates, if free, to flow or otherwise move towards the screens 30. Yet, as fluids are produced and enter the screens 30 (Block 108), the migrating formation particulates collect in the annulus 14 around the screens 30. However, the previously applied chemical additive prevents the formation particulates from substantially plugging the screens 30 or otherwise preventing the well from flowing by causing the formation particulates to agglomerate and form stable and permeable structures (e.g., 42 in FIG. 3) around the screens 30 (Block 110).

One suitable chemical additive that can be used for this purpose includes a Zeta Potential Altering System (hereafter called ZPAS). This type of chemical additive alters the Zeta potential of the downhole formation substrate so that formation particulates are attracted to each other. Zeta potential refers to the electrokinetic potential of the particulates and is represented by a charge of the particulates' surfaces.

The Zeta Potential Altering System (ZPAS) used for the chemical treatment (50) of the present disclosure can be a chemical additive based on an inner salt that modifies the zeta potential of the particulates. In particular, the system changes the particulates' charge towards neutral values, which enhances the agglomeration of the particulates.

Further details of the chemical additive for the Zeta Potential Altering System can be found in D. Johnson, et al., "Enhancing Gas and Oil Production With Zeta Potential Altering System," SPE 128048 (2010), which is discussed below. Other possible chemical additives could be used that alter the electrokinetic potential of the particulates.

As specifically discussed in SPE 128048, a Zeta Potential Altering System (ZPAS) can be used in hydraulic fracturing treatments. The system minimizes proppant flow back, controls fines migration, enhances fluid load recovery, and inhibits calcium carbonate scale formation. The Zeta Potential Altering System is based on an inner salt and modifies the zeta potential of particles such as fracture sand and formation substrate, changing the charge towards neutral values and therefore enhancing particle agglomeration. As also discussed in SPE 128048, formations can be treated by incorporating the chemical additive into stimulation fluids, and the chemical additive can be applied using several fluid systems to deliver the product.

As discussed in SPE 128048, Zeta Potential is defined by the charge that develops at the interface in the boundary of hydrodynamic shear between solid surfaces as a product of the electrostatic repulsion and the attractive forces related to the Van der Waals' forces. Therefore, zeta potential is a function of the surface charge of the particle, any adsorbed layer at the interface, and the nature and composition or the surrounding suspension medium. In other words, zeta potential can be affected by changes in pH, conductivity of the medium (salinity and kind of salt), and concentration of particular additives (polymer, non-ionic surfactants, etc.). Particles with zeta potential values between −20 and 20 mV have an effective charge low enough that the repulsion between them is lowered to a point where aggregation occurs.

As discussed in SPE 128048, the active ingredient of the Zeta Potential Altering System is an inner salt of a very low-molecular weight polymer. When added to fracture water as discussed in SPE 128048, the inner salt disperses and rapidly coats any metal oxide substrate, such as proppant or subterranean formation. The system also contains a penetrating alcohol capable of disrupting the water layer that coats solid surfaces in the formation. The system does not modify the chemical structure of friction reducers and gelling systems, such as non-ionic, cationic, and anionic polyacrylamide and guar gums and derivatives so the system is compatible with slick-water systems and borate-based crosslinked gels.

Figure 5:
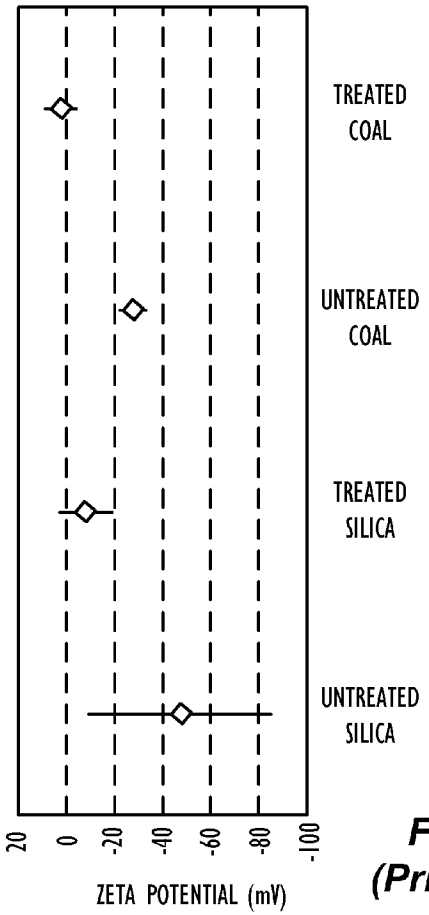
FIG. 5 (Prior Art)
FIG. 5 shows the change of zeta potential in silica and ground coal samples when treated with a Zeta Potential Altering System.

SPE 128048 provides a Figrure, reproduced here as FIG. 5, showing the change in the zeta potential in 325 mesh silica and in ground coal samples when treated at concentrations of 6 gal of ZPAS per 1,000 lb of silica or of coal material. In both cases, the ZPAS increases the mean zeta potential of the particles towards more neutral values with a lower standard deviation. The resulting values are in the zeta potential range where higher agglomerating effects are expected.

The particular aspects of the chemical additive applied in the chemical treatment 50 may depend on the expected chemistry downhole, including considerations of temperature, pressure, type of produce fluid, expected size of formation particulates, expected types of formation substrate, etc. Being able to treat the formation so that formation particulates form permeable, stable structures around the stand-alone screens 30 can eliminate the need to actively pack the annulus with gravel in a gravel pack operation. Moreover, the disclosed techniques can allow expandable sand screens (ESS) to be run in a cased hole, which can have advantages in some implementations. Use of the chemical treatment can also allow stand-alone screens 30 that have larger outside and inside dimensions to be installed downhole.

Treating the formation with chemical additive according to the present disclosure can preferably be done before or at the time of first production. Depending on the implementation, additional additive may be needed to continue to create or maintain the permeable structure in the annulus.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A borehole completion method, comprising;

treating a formation surrounding a borehole with a chemical treatment by passing the chemical treatment through a perforation in a casing of the borehole;

deploying a screen in the borehole;

allowing formation particulates to migrate to an annulus surrounding the screen by initially producing fluid from the formation;

agglomerating the formation particulates treated with the chemical treatment and produced with the fluid from the formation;

forming a gravel pack structure in the annulus surrounding the screen with the agglomerated formation particulates; and subsequently producing the fluid from the formation through the formed gravel pack structure and the screen.

2. The method of claim 1, wherein deploying the screen comprises deploying the screen before treating the formation, after treating the formation, during treatment of the formation, or a combination thereof.

3. The method of claim 1, wherein treating the formation comprises injecting the chemical treatment directly in the borehole.

4. The method of claim 1, wherein the chemical treatment comprises a chemical additive adapted to modify a zeta potential of the formation particulates.

5. The method of claim 4, wherein the chemical additive comprises an inner salt adapted to modify the zeta potential of the formation particulates.

6. The method of claim 1, wherein the screen comprises a wire screen, a mesh screen, a sintered metal screen, a perforated pipe, an expandable screen, a gravel pack screen, or a combination thereof.

7. The method of claim 1, wherein agglomerating the particulates comprises neutralizing a zeta potential of the formation particulates with the chemical treatment and agglomerating the neutralized zeta potential particulates into one or more permeable structures in the annulus.

8. The method of claim 1, further comprising isolating a portion of the formation with a packer disposed on a string having the screen.

9. The method of claim 1, comprising performing the agglomeration of the formation particulates instead of packing the annulus with gravel.

10. The method of claim 1, wherein treating the formation surrounding the borehole with the chemical treatment comprises:

injecting the chemical treatment in a fluid into the formation; and diverting the injected fluid into the formation that follows the fluid already migrating in the formation in response to an increased viscosity of the migrating fluid caused by reduced velocity and shear rate of the migrating fluid.

11. A method of completing a borehole for production, comprising:

treating portion of a formation surrounding a borehole with a chemical treatment affecting a surface charge of formation particulates;

deploying a screen on a string downhole;

allowing formation particulates to migrate to an annulus surrounding the screen by initially producing fluid from the formation; and aggregating the formation particulates produced from the formation into one or more permeable structures in the annulus surrounding the screen by allowing the formation particulates with the affected surface charge to attract to one another; and screening the produced fluid using the screen and the one or more permeable structures formed in the annulus.

12. The method of claim 11, wherein deploying the screen comprises deploying the screen before treating the formation, after treating the formation, during treatment of the formation, or a combination thereof.

13. The method of claim 11, wherein treating the formation comprises passing the chemical treatment through a perforation in a casing of the borehole.

14. The method of claim 11, wherein treating the formation comprises injecting the chemical treatment directly in the borehole.

15. The method of claim 11, wherein the chemical treatment comprises a chemical additive adapted to modify a zeta potential of the formation particulates.

16. The method of claim 15, wherein the chemical additive comprises an inner salt adapted to modify the zeta potential of the formation particulates.

17. The method of claim 11, wherein the screen comprises a wire screen, a mesh screen, a sintered metal screen, a perforated pipe, an expandable screen, a gravel pack screen, or a combination thereof.

18. The method of claim 11, wherein agglomerating the particulates comprises neutralizing a zeta potential of the formation particulates with the chemical treatment and agglomerating the neutralized zeta potential particulates into the one or more permeable structures in the annulus.

19. The method of claim 11, further comprising isolating a portion of the formation with a packer disposed on a string having the screen.

20. The method of claim 11, comprising performing the agglomeration of the formation particulates instead of packing the annulus with gravel.

21. The method of claim 11, wherein treating the portion of the formation surrounding the borehole with the chemical treatment affecting the surface charge of the formation particulates comprises:

injecting the chemical treatment in a fluid into the formation; and diverting the injected fluid into the formation that follows the fluid already migrating in the formation in response to an increased viscosity of the migrating fluid caused by reduced velocity and shear rate of the migrating fluid.

22. A borehole completion method, comprising:

treating a formation surrounding a borehole with a chemical treatment;

deploying a screen in the borehole, wherein the screen comprises a wire screen, a mesh screen, a sintered metal screen, a perforated pipe, an expandable screen, a gravel pack screen, or a combination thereof;

allowing formation particulates to migrate to an annulus surrounding the screen by initially producing fluid from the formation;

agglomerating the formation particulates treated with the chemical treatment and produced with the fluid from the formation;

forming a gravel pack structure in the annulus surrounding the screen with the agglomerated formation particulates; and subsequently producing the fluid from the formation through the formed gravel pack structure and the screen.

23. The method of claim 22, wherein deploying the screen comprises deploying the screen before treating the formation, after treating the formation, during treatment of the formation, or a combination thereof.

24. The method of claim 22, wherein treating the formation comprises injecting the chemical treatment directly in the borehole.

25. The method of claim 22, wherein the chemical treatment comprises a chemical additive adapted to modify a zeta potential of the formation particulates.

26. The method of claim 25, wherein the chemical additive comprises an inner salt adapted to modify the zeta potential of the formation particulates.

27. The method of claim 22, wherein agglomerating the particulates comprises neutralizing a zeta potential of the formation particulates with the chemical treatment and agglomerating the neutralized zeta potential particulates into one or more permeable structures in the annulus.

28. The method of claim 22, further comprising isolating a portion of the formation with a packer disposed on a string having the screen.

29. The method of claim 22, comprising performing the agglomeration of the formation particulates instead of packing the annulus with gravel.

30. The method of claim 22, wherein treating the formation surrounding the borehole with the chemical treatment comprises:

injecting the chemical treatment in a fluid into the formation; and diverting the injected fluid into the formation that follows the fluid already migrating in the formation in response to an increased viscosity of the migrating fluid caused by reduced velocity and shear rate of the migrating fluid.

31. A borehole completion method, comprising:

treating a formation surrounding a borehole with a chemical treatment;

deploying a screen in the borehole;

isolating a portion of the formation with a packer disposed on a string having the screen;

allowing formation particulates to migrate to an annulus surrounding the screen by initially producing fluid from the formation;

agglomerating the formation particulates treated with the chemical treatment and produced with the fluid from the formation;

forming a gravel pack structure in the annulus surrounding the screen with the agglomerated formation particulates; and subsequently producing the fluid from the formation through the formed gravel pack structure and the screen.

32. The method of claim 31, wherein deploying the screen comprises deploying the screen before treating the formation, after treating the formation, during treatment of the formation, or a combination thereof.

33. The method of claim 31, wherein treating the formation comprises injecting the chemical treatment directly in the borehole.

34. The method of claim 31, wherein the chemical treatment comprises a chemical additive adapted to modify a zeta potential of the formation particulates.

35. The method of claim 34, wherein the chemical additive comprises an inner salt adapted to modify the zeta potential of the formation particulates.

36. The method of claim 31, wherein agglomerating the particulates comprises neutralizing a zeta potential of the formation particulates with the chemical treatment and agglomerating the neutralized zeta potential particulates into one or more permeable structures in the annulus.

37. The method of claim 31, comprising performing the agglomeration of the formation particulates instead of packing the annulus with gravel.

38. The method of claim 31, wherein treating the formation surrounding the borehole with the chemical treatment comprises:

injecting the chemical treatment in a fluid into the formation; and diverting the injected fluid into the formation that follows the fluid already migrating in the formation in response to an increased viscosity of the migrating fluid caused by reduced velocity and shear rate of the migrating fluid.

* * * * *